US011074873B2

(12) United States Patent
Liu et al.

(10) Patent No.: US 11,074,873 B2
(45) Date of Patent: Jul. 27, 2021

(54) DISPLAY DEVICE AND DISPLAY DRIVING METHOD

(71) Applicant: E Ink Holdings Inc., Hsinchu (TW)

(72) Inventors: Shu-Cheng Liu, Hsinchu (TW); Hsiao-Lung Cheng, Hsinchu (TW); Pei-Lin Tien, Hsinchu (TW); Chi-Mao Hung, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 16/554,640

(22) Filed: Aug. 29, 2019

(65) Prior Publication Data

US 2020/0074942 A1 Mar. 5, 2020

(30) Foreign Application Priority Data

Aug. 31, 2018 (TW) ..... 107130512

(51) Int. Cl.

*G09G 3/36* (2006.01)
*G09G 3/34* (2006.01)
*G09G 5/393* (2006.01)

(52) U.S. Cl.

CPC ..... *G09G 3/344* (2013.01); *G09G 3/36* (2013.01); *G09G 5/393* (2013.01); *G09G 2310/04* (2013.01); *G09G 2310/08* (2013.01); *G09G 2320/10* (2013.01); *G09G 2340/16* (2013.01)

(58) Field of Classification Search

CPC ..... G09G 3/344; G09G 5/393; G09G 3/36; G09G 2310/08; G09G 2310/04; G09G 2320/10; G09G 3/3622; G09G 2340/16

See application file for complete search history.

(56) References Cited

U.S. PATENT DOCUMENTS

| | | | |
|---|---|---|---|
| 8,605,032 | B2 | 12/2013 | Liu et al. |
| 8,988,404 | B2 | 3/2015 | Park et al. |
| 9,390,680 | B2 | 7/2016 | Jeon et al. |
| 9,412,292 | B2 | 8/2016 | Lee |
| 9,424,805 | B2 | 8/2016 | Lee et al. |
| 2003/0179170 | A1 | 9/2003 | Lee |

(Continued)

FOREIGN PATENT DOCUMENTS

| | | |
|---|---|---|
| CN | 105761695 | 7/2016 |
| CN | 106856088 | 6/2017 |

(Continued)

OTHER PUBLICATIONS

"Office Action of China Counterpart Application", dated Sep. 3, 2020, pp. 1-7.

*Primary Examiner* — Towfiq Elahi
(74) *Attorney, Agent, or Firm* — JCIPRNET

(57) ABSTRACT

A display device and a display driving method are provided. The display device includes a display panel and a timing controller. A timing controller is configured to drive the display panel. A memory is configured to store previous image data. The timing controller sequentially receives a plurality of current image data during an image update period, and compares the plurality of current image data to the previous image data to sequentially generate a plurality of driving signals. The timing controller sequentially outputs the plurality of driving signals to the display panel during the screen update period to update a display screen of the display panel.

7 Claims, 3 Drawing Sheets

(56) References Cited

U.S. PATENT DOCUMENTS

| | | | | |
|---|---|---|---|---|
| 2009/0284499 | A1* | 11/2009 | Kim | G09G 3/20 345/204 |
| 2010/0134504 | A1* | 6/2010 | Nam | G09G 3/344 345/536 |
| 2012/0038752 | A1 | 2/2012 | Sang | |
| 2013/0321365 | A1* | 12/2013 | Chang | G09G 3/3692 345/204 |
| 2015/0187427 | A1 | 7/2015 | Oh | |
| 2017/0295343 | A1* | 10/2017 | Konishi | G09G 3/3666 |
| 2019/0182509 | A1* | 6/2019 | Kim | G09G 3/2044 |

FOREIGN PATENT DOCUMENTS

| | | |
|---|---|---|
| CN | 207009060 | 2/2018 |
| KR | 100403718 | 10/2003 |
| TW | 201310438 | 3/2013 |
| TW | 201528205 | 7/2015 |

* cited by examiner

DISPLAY DEVICE AND DISPLAY DRIVING METHOD

CROSS REFERENCE TO RELATED APPLICATION

This application claims the priority benefit of Taiwan application serial no. 107130512, filed on Aug. 31, 2018. The entirety of the above-mentioned patent application is hereby incorporated by reference herein and made a part of specification.

BACKGROUND OF THE DISCLOSURE

Field of the Disclosure

The disclosure relates to a display driving technique, and more particularly to a display device and a display driving method.

Description of Related Art

In general, the driving structure of the existing Electro-Phoretic Display (EPD) device uses an external micro control unit (MCU), a system on chip (SoC) or other embedded system, which functions as a system application master to control the display content of the electrophoretic display panel by controlling a timing controller (TCON) of the electrophoretic display device. Moreover, the timing controller of the known electrophoretic display device needs to store the data of the previous image and the next image in the memory to output the corresponding driving signal to the electrophoretic display panel by comparing the data of the previous image and the next image, and update the display content of the electrophoretic display panel. However, when the resolution of the electrophoretic display panel is higher, the driving structure of the existing electrophoretic display device requires a larger memory space to store image data, so that a high-resolution display effect can be achieved, thus resulting in that the cost of setting up memory components or other circuits of an electrophoretic display device increases. In view of this, solutions of several embodiments are presented below.

SUMMARY OF THE DISCLOSURE

The disclosure provides a display device and a display driving method capable of effectively updating a display screen of a display panel, and effectively saving a storage space required for the display device to update a screen, and a setup cost of the memory component.

The display device of the disclosure includes a display panel and a timing controller. The timing controller is coupled to the display panel. The timing controller is configured to drive the display panel. The memory is configured to store previous image data. The timing controller sequentially receives a plurality of current image data during a screen update period, and compares the plurality of current image data with the previous image data to generate a plurality of corresponding driving signals. The timing controller sequentially outputs the plurality of driving signals to the display panel during the screen update period to update a display screen of the display panel.

In an embodiment of the disclosure, the timing controller does not store the plurality of current image data into the memory during the screen update period.

In an embodiment of the disclosure, when the screen update period ends, the timing controller writes the last one of the plurality of current image data into the memory to replace the previous image data.

In an embodiment of the disclosure, during the screen update period, the plurality of current image data correspond to the same image content.

In an embodiment of the disclosure, the display screen of the display panel is changed from displaying a previous image screen into displaying a current image screen during the screen update period.

In an embodiment of the disclosure, during the screen update period, the timing controller sequentially receives the plurality of current image data at a first frequency, and the timing controller sequentially outputs the plurality of driving signals to the display panel at a first frequency.

In an embodiment of the disclosure, the display panel is an electrophoretic display panel.

In an embodiment of the disclosure, the timing controller receives the plurality of current image data provided through a liquid crystal display interface of a front-end system.

A display driving method of the disclosure includes the following steps: storing previous image data through the memory; sequentially receiving a plurality of current image data during the screen update period, and comparing the plurality of current image data to the previous image data to generate a plurality of corresponding driving signals; and sequentially outputting the plurality of driving signals to the display panel during the screen update period to update the display screen of the display panel.

In an embodiment of the disclosure, the display driving method further includes the following step: writing the last one of the plurality of current image data into the memory after the screen update period ends to replace the previous image data.

Based on the above, the display device and the display driving method of the disclosure may compare the previous image data stored in the memory one by one by using a plurality of current image data sequentially received to generate a plurality of corresponding driving signals, and drive the display panel. In other words, the memory of the display device of the disclosure may efficiently drive the display panel without storing all of the current image data.

In order to make the aforementioned features and advantages of the disclosure more comprehensible, embodiments accompanying figures are described in detail below.

DESCRIPTION OF EMBODIMENTS

To facilitate understanding, descriptions of the disclosure are given with reference to the exemplary embodiments illustrated with accompanied drawings. In addition, whenever possible, identical or similar reference numbers stand for identical or similar elements/components/steps in the figures and the embodiments.

Figure 1:
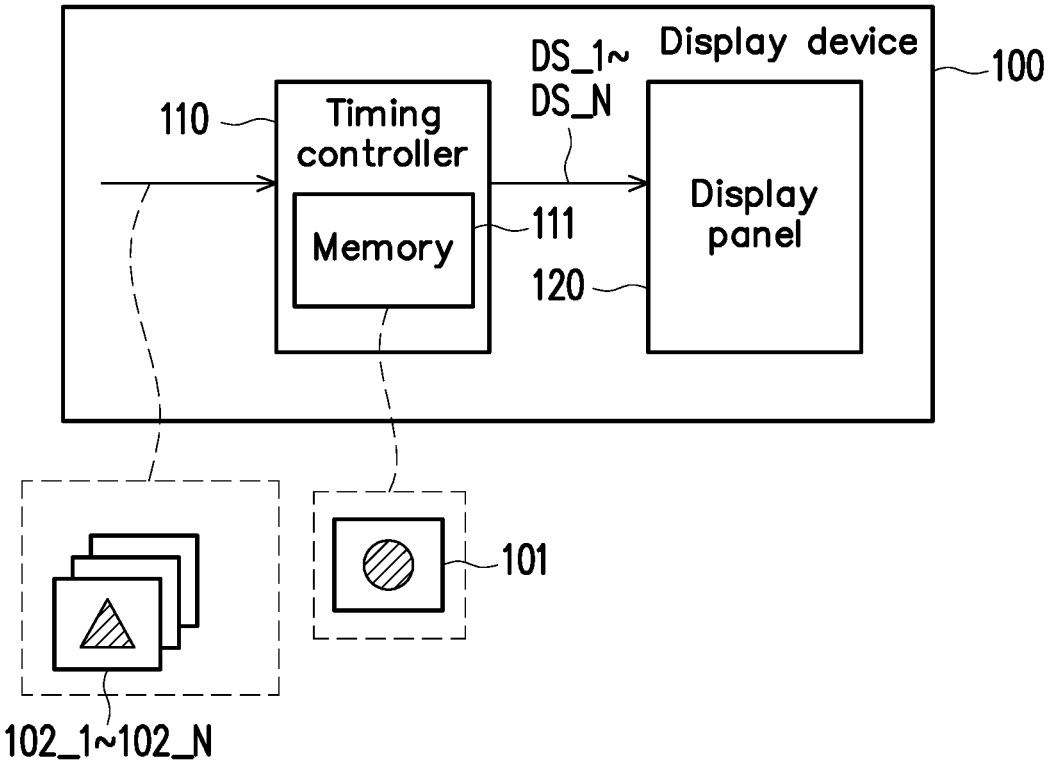
FIG. 1 is a block diagram of a display device according to an embodiment of the disclosure.

FIG. 1 is a block diagram of a display device according to an embodiment of the disclosure. Referring to FIG. 1, a display device 100 includes a timing controller (TCON) 110, a memory 111, and a display panel 120. The timing controller 110 is coupled to the display panel 120, and the timing controller 110 may include a memory 111. However, the disclosure is not limited thereto, and the memory 111 may not be disposed in the timing controller 110. The memory 111 is a dynamic random access memory (DRAM), a flash memory, or a non-volatile random access memory (NVRAM). The disclosure is not limited to the above. The memory 111 may be used to store the image data provided by a front-end system. In this embodiment, the display panel 120 may be an electro-phoretic display panel (EPD), and may further include a plurality of electrophoresis units, an electrophoretic display panel driving chip, and a thin film-transistor (TFT) backplane, a power supply circuit, etc., but the disclosure is not limited thereto. In an embodiment, the display panel 120 may also be other types of display panels, such as a liquid crystal display (LCD), an organic light-emitting diode (OLED), or a micro LED display panel and so on.

In the embodiment, the display panel 120 may display a previous display screen, and the memory 111 of the timing controller 110 stores the previous image data 101 corresponding to the previous display screen. During a screen update period, the timing controller 110 may continuously receive the current image data 102_1~102_N provided by the front-end system, where N is a positive integer greater than zero. The timing controller 110 may compare the current image data 102_1~102_N with the previous image data 101 to generate corresponding driving signals DS_1~DS_N. The timing controller 110 may continuously drive the display panel 120 by the driving signals DS_1~DS_N to update the previous display screen displayed by the display panel 120 into the current display screen corresponding to the current image data 102_1~102_N. Moreover, after the screen update period ends, the timing controller 110 may write the last current image data of the current image data 102_1~102_N into the memory 111 of the timing controller 110, and replace the previous image data 101 for use during the next screen update period, but the disclosure is not limited thereto. In an embodiment, the timing controller 110 may write at least one of the current image data 102_1~102_N into the memory 111 of the timing controller 110. Therefore, the display device 100 of the present embodiment may effectively save the storage space of the memory 111 that the display device needs to use when updating the screen.

For example, the display panel 120 may be an electrophoretic display panel and includes a plurality of electrophoresis units. In the case where the timing controller 110 does not provide a driving signal, since each of the plurality of electrophoretic particles of the electrophoresis units may be in a fixed electrophoretic distribution state, the display panel 120 may maintain the display screen as a previous display screen, and the screen update is performed only after the timing control 110 provides a new driving signal. The memory 111 of the timing controller 110 may previously store the previous image data 101 corresponding to the previous display screen. During a screen update period, the timing controller 110 may continuously receive the current image data 102_1~102_N provided by the front-end system, and compare the current image data 102_1~102_N one by one with the previous image data 101 to sequentially generate A plurality of driving signals DS_1~DS_N. These driving signals DS_1~DS_N refer to the data codes required to drive the electrophoretic display panel.

In addition, it should be noted that the timing controller 110 may sequentially receive the current image data 102_1~102_N at a first frequency, and the timing controller 110 may sequentially output the driving signals DS_1~DS_N to the display panel 120 at the first frequency of the same rate, but the disclosure is not limited thereto. In an embodiment, the rate at which the timing controller 110 receives the image data may be different from the rate at which the driving signal is output.

In the example, the driving signals DS_1~DS_N may respectively include a plurality of different driving voltages corresponding to the electrophoresis units to drive the electrophoretic particles in each of the electrophoresis unit to a corresponding electrophoretic distribution state. In this example, the timing controller 110 may continuously drive the electrophoretic units in the display panel 120 through the driving signals DS_1~DS_N to gradually change the respective electrophoretic distribution states of the electrophoretic units. That is to say, during the screen update period, the current image data 102_1~102_N may be the same image data (for example, a static image). However, the number of current image data 102_1~102_N may be determined according to different display panel characteristics or screen update requirements, and the disclosure is not limited thereto. Moreover, more importantly, during the screen update period, the timing controller 110 does not need to store all of the current image data 102_1~102_N into the memory 111. After the display screen of the display panel 120 is updated, the timing controller 110 may write the last current image data 102_N of the current image data 102_1~102_N into the memory 111 of the timing controller 110, and replace the previous image data 101 for use during the next screen update period.

Figure 2:
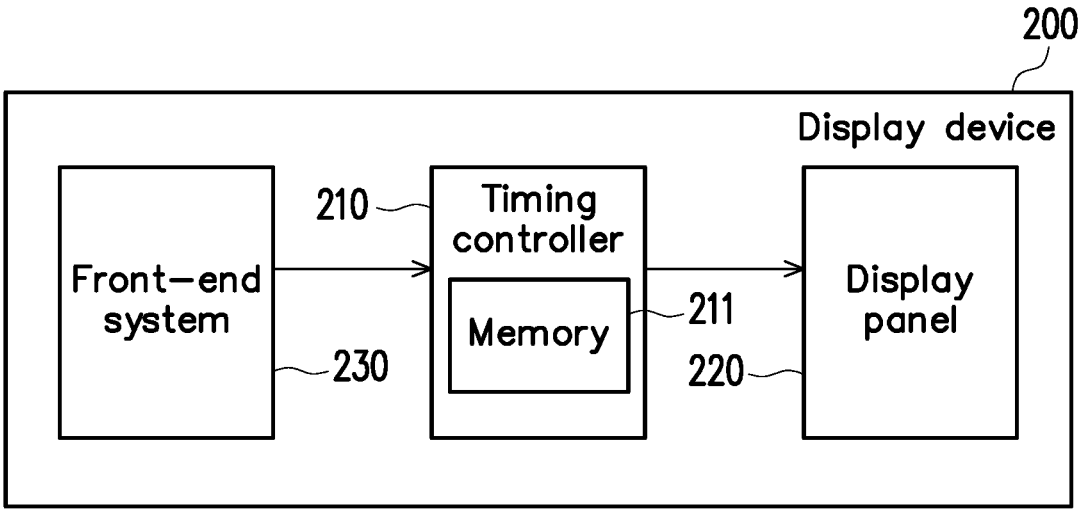
FIG. 2 is a block diagram of a display device according to another embodiment of the disclosure.

FIG. 2 is a block diagram of a display device according to another embodiment of the disclosure. Referring to FIG. 2, a display device 200 includes a timing controller 210, a display panel 220, and a front-end system 230. The timing controller 210 is coupled to the display panel 220. In this embodiment, the front-end system 230 may be a driving system of a liquid crystal display (LCD) and coupled to the timing controller 210 through a liquid crystal display interface. However, in an embodiment, the front-end system 230 may also be disposed outside the display device 200, and is not limited to being integrated in the display device 200.

In this embodiment, the display device 200 may be an electrophoretic display device, and the display panel 220 may be an electrophoretic display panel. The display device 200 may acquire image data using the same interface as the liquid crystal display, and drive the electrophoretic display panel. In this embodiment, the front-end system 230 may continuously provide a plurality of identical image data to the timing controller 210 for each of the display screens, so that the timing controller 210 can continuously receive the same image data during each of the update screen periods to be compared with a previous image data stored previously by the memory 211 one by one to sequentially generate a plurality of driving signals for driving the electrophoretic display panel. That is, the display device 200 of the embodiment may combine the electrophoretic display panel with the display driving system of the liquid crystal display, and the electrophoretic display panel can be driven by simply designing a driving protocol of the display driving system of the liquid crystal display, thereby effectively saving the design cost of the driving system of the electrophoretic display.

In addition, regarding the feature and the technical details of the timing controller 210 and the display panel 220 of the embodiment and other devices, reference may be made to the description of the display device 100 of the embodiment of FIG. 1 above, and sufficient teaching, suggestion, and implementation instructions can be obtained therefrom, and thus related descriptions are omitted hereafter.

Figure 3:
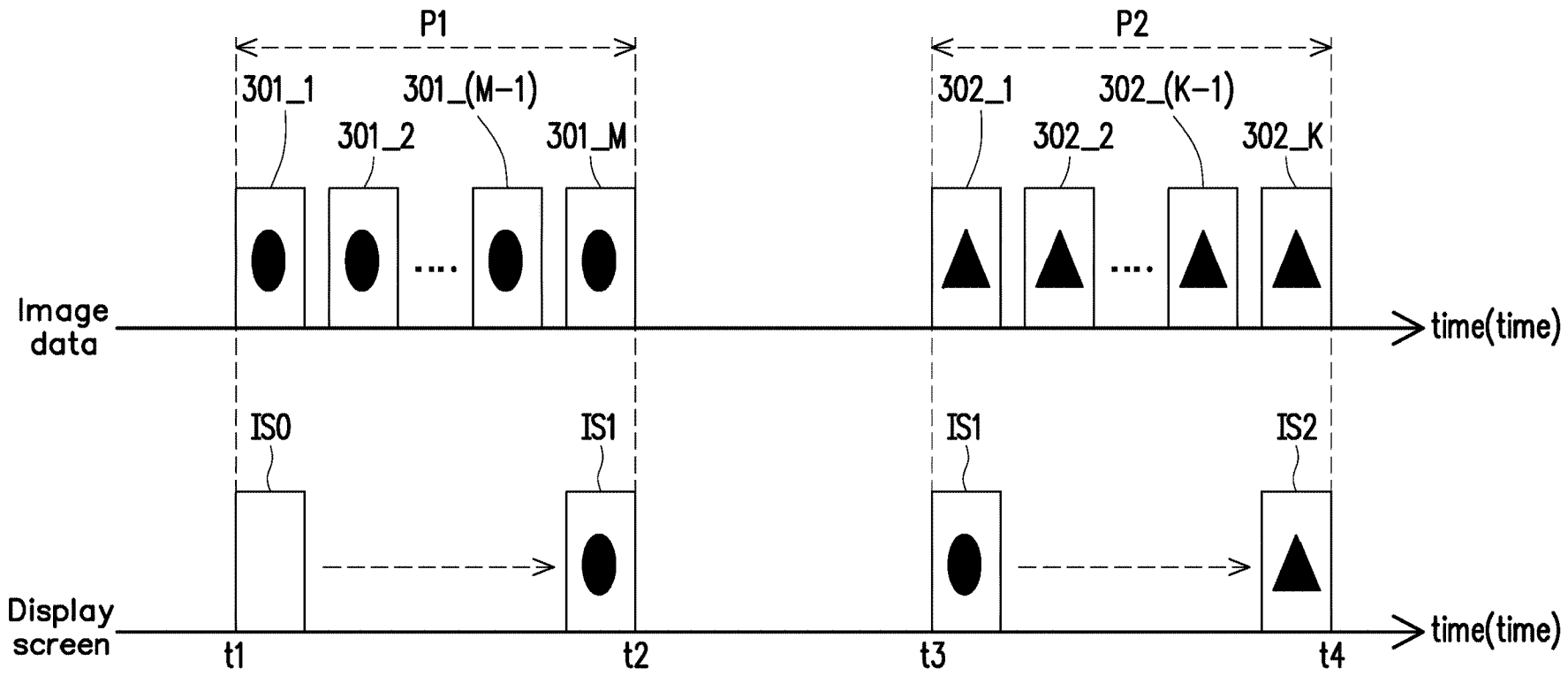
FIG. 3 is a timing diagram of a screen update period according to an embodiment of the disclosure.

FIG. 3 is a timing diagram of a screen update period according to an embodiment of the disclosure. The timing diagram of the screen update period of FIG. 3 may be applied to the display devices 100 and 200 of FIG. 1 and FIG. 2. The following embodiment is described using the display device 200 of FIG. 2. Referring to FIG. 2 and FIG. 3, first, an initial display screen ISO of the display panel 220 of the display device 200 may be a blank screen. When the display device 200 wants to update the display content of the display panel 220, in the screen update period P1 (starting from time t1), the timing controller 210 may continuously and sequentially receive a plurality of image data 301_1, 301_2~301_(M−1), 301_M, and these image data 301_1, 301_2-301_(M−1), 301_M correspond to the same image content, where M is a positive integer greater than zero. The timing controller 210 may compare the image data 301_1, 301 2-301 (M−1), and 301_M one by one with the image data of the display screen ISO stored in the memory 211 previously to obtain a plurality of corresponding driving signals. The timing controller 210 may simultaneously and sequentially output the driving signals to the display panel 220 in order to gradually update the display content of the display panel 220. Therefore, after the screen update period P1 ends (ended at time t2), the display panel 220 can display a new display screen IS1. Further, the timing controller 210 writes the last image material (for example, 301_M) into the memory 211 to replace the image data of the display screen ISO previously stored in the memory 211.

Next, when the display device 200 wants to update the display content of the display panel 220 again, in the screen update period P2 (starting from time t3), the timing controller 210 may continuously and sequentially receive the plurality of image data 302_1, 302_2~302_(K−1), 302_K, and these image data 302_1, 302 2~302 (K−1), 302_K correspond to the same image content, where K is a positive integer greater than zero. The timing controller 210 may compare the image data 302_1, 302 2~302 (K−1), 302_K one by one with the image data (for example, 301_M) of the display screen IS1 stored in the memory 211 previously to obtain other plurality of corresponding driving signals. The timing controller 210 may simultaneously and sequentially output the driving signals to the display panel 220 in order to gradually update the display content of the display panel 220. Therefore, after the screen update period P2 ends (ended at time t4), the display panel 220 can display a new display screen IS2. Further, the timing controller 210 writes the last image data (for example, 302_K) into the memory 211 to replace the image data of the display screen IS1 previously stored in the memory 211.

That is, in the screen update periods P1, P2, the timing controller 210 may continuously receive the image data 301 1-301_M, 302_1~302_K provided by the front-end system 230, and compared with the image data previously stored in the memory 211 one by one, thereby generating a corresponding driving signal. Moreover, in the screen update periods P1 and P2, the display content of the display panel 220 is gradually changed from displaying the previous image screen into displaying the current image screen, and the timing controller 210 deletes the image data 301_1~301_M, 302_1~302_K one by one after comparison is completed. Until the screen update period P1, P2 end, the timing controller 210 writes the last image data into the memory 211 to replace the previous image data. In other words, the memory 211 of the timing controller 210 does not need to completely store the image data 301_1~301_M, 302_1~302_K provided by the front-end system 230. Therefore, the display device 200 can effectively save the memory space of the memory 211 which is required for display driving.

Figure 4:
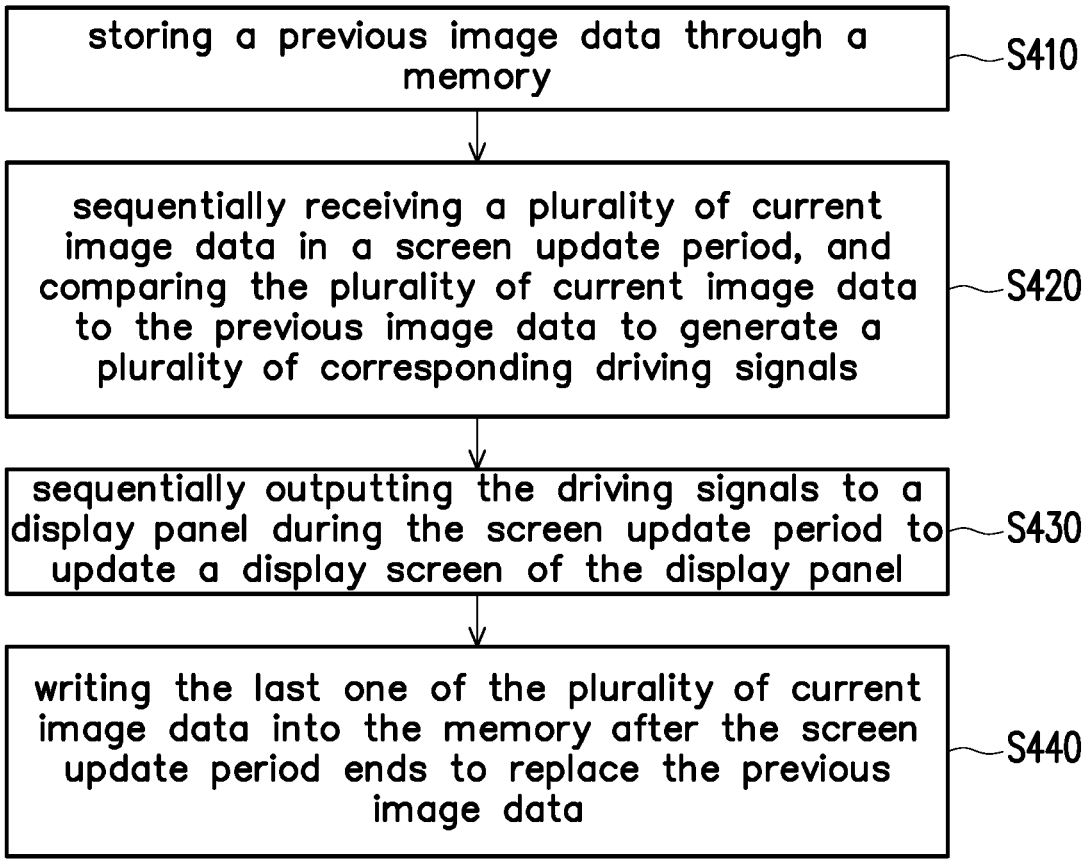
FIG. 4 is a flowchart of a display driving method according to an embodiment of the disclosure.

FIG. 4 is a flowchart of a display driving method according to an embodiment of the disclosure. Referring to FIG. 1 and FIG. 4, the display driving method of the present embodiment is at least adaptable to the display device 100 of the embodiment of FIG. 1. The display device 100 may perform the following steps S410 to S440. In step S410, the display device 100 may store the previous image data 101 through the memory 111. In step S420, during the screen update period, the display device 100 may sequentially receive the plurality of current image data 102_1~102_N, and compare the current image data 102_1~102_N one by one with the previous image data 101 to sequentially generate multiple driving signals DS_1~DS_N. In step S430, during the screen update period, the display device 100 may sequentially output the driving signals DS_1~DS_N to the display panel 120 to drive the display panel 120. In step S440, after the screen update period ends, the display device 100 may write the last one of the current image data 102_1~102_N into the memory 111 to replace the previous image data 101. Therefore, the display driving method of the present embodiment may effectively update the display content of the display panel 120, and can effectively save the storage space of the memory 111 that the display device 100 needs to use when updating the screen.

In addition, regarding the feature and the technical details of the timing controller 110 and the display panel 120 of the embodiment and other devices, reference may be made to the description of the embodiment of FIG. 1 above, and sufficient teaching, suggestion, and implementation instructions can be obtained therefrom, and thus related descriptions are omitted hereafter.

In summary, the display device and the display driving method of the disclosure may effectively update the display screen of the display panel during the screen update period by simply storing one previous image data into the memory of the timing controller. Moreover, the display device of the disclosure may apply the display driving system of the liquid crystal display to receive the image data through the liquid crystal display interface, thereby effectively updating the display content of the electrophoretic display panel. Therefore, the display device and the display driving method of the disclosure can effectively save the storage space required for the display device when updating the screen, and can effectively save the design cost of the driving system of the display device.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A display device, comprising:

a display panel, wherein the display panel is an electrophoretic display panel; and a timing controller, coupled to the display panel, configured to drive the display panel, and comprises one memory configuring to only store one previous image data corresponding to one previous image screen of a pervious screen update period, wherein the timing controller sequentially receives a plurality of current image data of a plurality of identical images corresponding to one current image screen during a screen update period, and sequentially compares the plurality of current image data with the same one previous image data to sequentially generate a plurality of corresponding driving signals, wherein the plurality of current image data correspond to same image content of the one current image screen during the screen update period, wherein the timing controller sequentially outputs the plurality of driving signals to the display panel during the screen update period to update a display screen of the display panel, wherein the display screen of the display panel is changed from displaying the one previous image screen to displaying the one current image screen during the screen update period, wherein a first frequency of the timing controller receiving the plurality of current image data is higher than a screen update frequency of the display panel.

2. The display device according to claim 1, wherein the timing controller does not store the plurality of current image data into the memory during the screen update period.

3. The display device according to claim 1, wherein the timing controller writes the last one of the plurality of current image data into the memory to replace the previous image data after the screen update period ends.

4. The display device according to claim 1, wherein the timing controller sequentially receives the plurality of current image data at the first frequency during the screen update period, and the timing controller sequentially outputs the driving signals to the display panel at the first frequency.

5. The display device according to claim 1, wherein the timing controller receives the plurality of current image data provided through a liquid crystal display interface of a front-end system.

6. A display driving method, comprising:

only storing one previous image data corresponding to one previous image screen of a pervious screen update period through one memory of a timing controller;

sequentially receiving a plurality of current image data of a plurality of identical images corresponding to one culTent image screen during a screen update period, and sequentially comparing the plurality of current image data with the same one previous image data to sequentially generate a plurality of corresponding driving signals, wherein the plurality of current image data correspond to the image content of the one current image screen during the screen update period; and outputting the driving signals sequentially to a display panel during the screen update period to update a display screen of the display panel, wherein the display panel is an electrophoretic display panel, wherein the display screen of the display panel is changed from displaying the one previous image screen into displaying the one current age screen during the screen update period, wherein a first frequency of the timing controller receiving the plurality of current image data is higher than a screen update frequency of the display panel.

7. The display driving method according to claim 6, further comprising:

writing the last one of the plurality of current image data into the memory after the screen update period ends to replace the previous image data.

* * * * *